US005141286A

United States Patent [19]

Ayala, Jr. et al.

[11] Patent Number: 5,141,286

[45] Date of Patent: Aug. 25, 1992

[54] HIGH CHAIR BABY SEATER

[75] Inventors: Raymond J. Ayala, Jr.; Sam W. Gainer, both of Houston, Tex.

[73] Assignee: Lil Tot's Safe Care Products Inc., Houston, Tex.

[21] Appl. No.: 574,776

[22] Filed: Aug. 30, 1990

[51] Int. Cl.[5] ..... A47C 31/00

[52] U.S. Cl. ..... 297/464; 297/438; 297/423

[58] Field of Search ..... 297/252, 423, 438, 464, 297/466, 487, 488; 108/43; 24/298, 300, 301

[56] References Cited

U.S. PATENT DOCUMENTS

| | | | |
|---|---|---|---|
| 1,000,801 | 8/1911 | Hansche | 297/252 |
| 1,964,193 | 6/1934 | Burnett | 297/438 X |
| 2,697,018 | 12/1954 | Georgides | 108/43 |
| 2,820,269 | 1/1958 | Wolff | 24/300 X |
| 2,988,135 | 6/1961 | Caminiti | 297/487 X |
| 3,311,410 | 3/1967 | Hill | 297/423 |
| 4,667,993 | 5/1987 | Hannesson et al. | 24/298 X |
| 4,712,833 | 12/1987 | Swanson | 297/464 X |
| 4,744,602 | 5/1988 | Campbell et al. | 297/466 X |

FOREIGN PATENT DOCUMENTS

| | | | |
|---|---|---|---|
| 664599 | 6/1963 | Canada | 297/467 |

*Primary Examiner*—Peter R. Brown
*Attorney, Agent, or Firm*—M. H. Gay

[57] ABSTRACT

The disclosure relates to a high chair restraining assembly for infants that may be used in lieu of traditional seat belts, etc. The High Chair Baby Seater consists of a large wooden dowel or similar suitable material that is placed under the infant's legs and secured to the sides of the high chair by way of two hooks and a resilient connection attached to small dowels inside the large dowel. The Baby Seater can fit various sizes of high chairs and remain comfortable and safe for the infant.

2 Claims, 1 Drawing Sheet

HIGH CHAIR BABY SEATER

BACKGROUND OF THE INVENTION

1. Field of the Invention

The invention relates to the field of high chairs and, in particular, to securing infants into high chairs without using awkward or dangerous belts or other means.

2. Description of the Prior Art

While there are numerous devices available for retaining infants in high chairs none is of similar construction to applicant's. Moreover, none of the currently available devices can accommodate differently sized and configured high chairs in as simple and safe a manner as the device of the present invention. The device represents an improvement over the prior art in that the device is safe, convenient and easy to manufacture.

SUMMARY OF THE INVENTION

The Baby Seater of the present invention is designed to fit onto the majority of the today's available high chairs. The device comprises a large dowel made of wood or similar material providing a bumper and two small dowels made of wood or similar material with securing hooks at each end. The hooks are in resilient relation to each other by means of an elastic, rubber or otherwise stretchable cord that allows the hooks to be stretched onto the framework or vertical support posts that hold up the arms of most modern high chairs.

It is the object of this invention to provide a high chair securing means that is safe as well as comfortable.

Another objective of the invention is to provide a device that will secure an infant in a high chair and accomodate a wide range of high chairs that vary in size and configuration.

Another objective is to provide a high chair securing means that can be easily and inexpensively produced.

Other advantages of the invention should be readily apparent to those skilled in the art once the invention has been described.

DESCRIPTION OF THE PREFERRED EMBODIMENT

Figure 1:
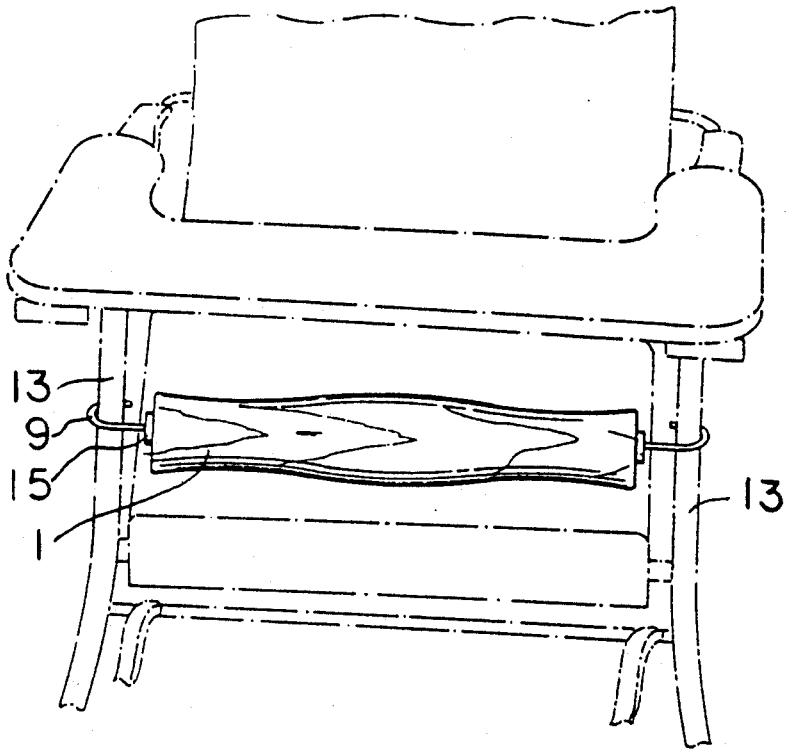
FIG. 1 shows the high chair with the Baby Seater in use.

The Baby Seater has a dowel or bumper 1 (FIG. 1) made from wood, plastic or other suitable material that is secured to the support posts 13 (shown in FIG. 1) that come with most modern high chairs by means of a securing means 9 at one end of each of the small dowels 7. The small dowels 7 (in FIG. 2) fit within the hollowed out interior portion 2 of the large dowel. The small dowels are placed so that a portion of each 15 (see FIG. 1) protrudes outside of the large dowel or bumper (designated the "exterior end"). This makes for two ends for each of the small dowels, designated the "interior" and "exterior" ends depending on their relation to the large dowel.

The securing means 9 (see FIG. 2) are attached to the exterior ends of the small dowels so that they protrude out of the ends of the large dowel when the Baby seater is constructed. The securing means are then connected to the vertically oriented support posts 13 (FIG. 1) of the frame of the high chair to secure the large dowel in place under the thighs of the infant.

The small dowels that support the securing means are connected by a resilient member 3 (in FIG. 2) that is placed through the center of the large dowel or bumper 1. This also keeps the seater attached to the high chair and make it very difficult for the infant to work himself or herself out of the high chair.

The Baby Seater is constructed with a large dowel piece or bumper that may be padded 11 (FIG. 2), or other wise made to be comfortable against the back of the thighs of the infant. The large dowel piece should be of strong durable material as it must resist the force of the infant if he or she attempts to struggle out of the high chair.

When used, the Baby Seater is placed under the thighs of the infant and then secured into place around the vertical posts of the high chair by means of the hooks 9. The Baby Seater helps resist the struggles of the infant to get out of the seat.

Figure 2:
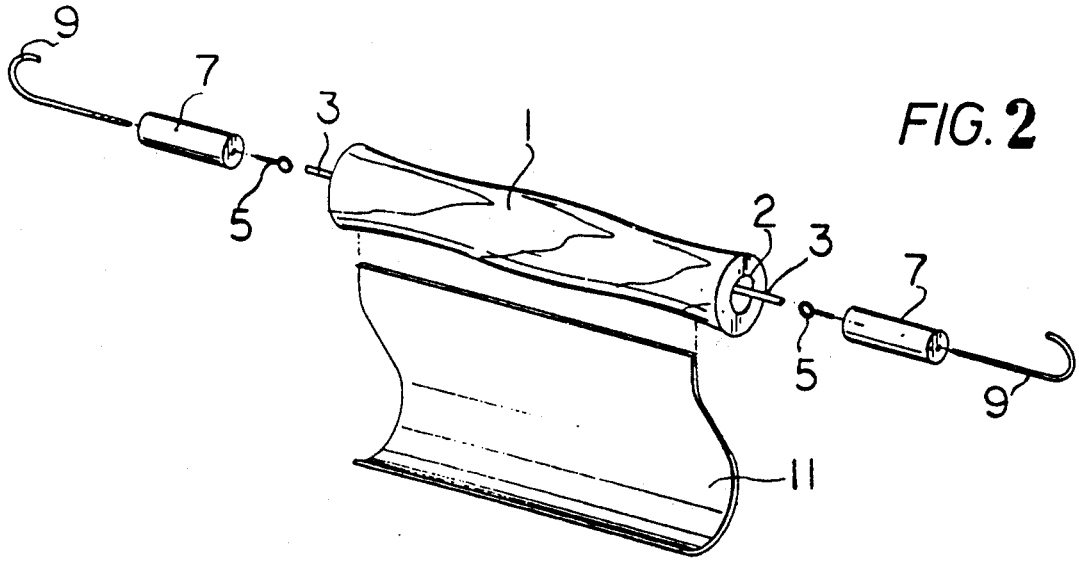
FIG. 2 shows the construction of the interior of the baby seater illustrating the large dowel or bumper and the two smaller dowels.
Figure 3:
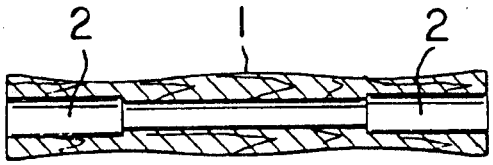

Referring to FIG. 2, inside the large dowel is an elastic piece 3, which can be made of rubber, elastic, or other similar material. The elastic piece is connected by eye hooks 5 or other attaching means to the interior ends of each small dowel 7, the interior ends of the small dowel being those ends of each small dowel that remain inside the large dowel when the seater is constructed. To complete the device, two large plastic or rubber coated hooks 9 (or other attaching means capable of being secured to the vertical posts) are attached to the external ends of the two small dowels, i.e.: those ends of each of the small dowels that stick out of the ends of the large dowel when used.

Because the two securing means are in resilient relation to each other many of the advantages of the present invention are realized. The securing means can resist the tugs or pushes of the infant and thus secure him or her in the high chair. The securing means can thus be arranged to fit the majority or high chairs currently available since the securing means may be stretched to fit the distance between the vertically oriented support posts on the high chair.

The securing means may comprise any means that are capable of fitting in connection with the vertical posts that are usually found on high chairs. It is preferred that the securing means be hooks since they can readily be fit around the vertical posts. Other securing means may comprise Velcro (trademark name for hook and loop material), snap hooks that have to be opened and to be used and can then be closed after they are placed around the posts. These would provide an additional securing feature.

I claim:

1. Apparatus for securing infants securely within a high chair having opposed side posts extending upwardly from the high chair seat comprising;

an elongate bumper positional on the high chair seat between opposed side posts of the chair, said bumper having a hole extending through its elongate dimension, a pair of dowels reciprocal in said hole and extendable from each end of the bumper, attachment means including rigid U-shaped hooks extending from the exterior ends of each dowel and engagable about opposed side posts of the chair, and resilient means in said bumper hole and urging the dowels toward each other in said bumper hole, the construction and arrangement of said bumper and said dowels permitting the dowels to be reciprocated in said bumper hole to engage said hooks with said side posts and when said hooks are so engaged to fit within said bumper hole and provide a structure extending from side post to side post which is substantially rigid and immovable toward the front or back of said chair and fills a portion of the space between the seat and tray of a high chair.

2. The apparatus of claim 1 wherein the bumper is substantially cylindrical and said dowels are cylindrical and reciprocate within cylindrical counterbores provided in opposed ends of said dowel hole.

* * * * *